US010745035B2

(12) United States Patent
Brandstetter et al.

(10) Patent No.: US 10,745,035 B2
(45) Date of Patent: Aug. 18, 2020

(54) CONNECTING MEMBER FOR TWO LONGITUDINAL MEMBERS OF A RAIL VEHICLE

(71) Applicant: SIEMENS AG ÖSTERREICH, Vienna (AT)

(72) Inventors: Jochen Brandstetter, Graz (AT); Christian Kueter, Stattegg (AT); Gerald Schobegger, Graz (AT); Martin Teichmann, Graz (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 446 days.

(21) Appl. No.: 15/551,461

(22) PCT Filed: Feb. 10, 2016

(86) PCT No.: PCT/EP2016/052821
§ 371 (c)(1),
(2) Date: Aug. 16, 2017

(87) PCT Pub. No.: WO2016/131691
PCT Pub. Date: Aug. 25, 2016

(65) Prior Publication Data

US 2018/0043909 A1 Feb. 15, 2018

(30) Foreign Application Priority Data

Feb. 17, 2015 (AT) ..... A 50120/2015

(51) Int. Cl.
*B61F 5/52* (2006.01)

(52) U.S. Cl.
CPC ..... *B61F 5/52* (2013.01)

(58) Field of Classification Search
CPC ..... B61F 5/52
See application file for complete search history.

(56) References Cited

U.S. PATENT DOCUMENTS

| | | | | |
|---|---|---|---|---|
| 7,004,078 | B2 * | 2/2006 | Nishimura | B61F 5/52 105/157.1 |
| 2002/0139276 | A1 * | 10/2002 | Nast | B61C 9/52 105/33 |
| 2004/0123767 | A1 * | 7/2004 | Nishimura | B61F 5/52 105/157.1 |

(Continued)

FOREIGN PATENT DOCUMENTS

| | | |
|---|---|---|
| CN | 201116124 Y | 9/2008 |
| CN | 201347090 | 11/2009 |
| CN | 2019514790 U | 8/2011 |

(Continued)

*Primary Examiner* — Jason C Smith
(74) *Attorney, Agent, or Firm* — Cozen O'Connor

(57) ABSTRACT

A connecting member for connecting two longitudinal members of a bogie frame of a rail vehicle includes at least one fastening point for receiving add-on components, at least a first member element with a first member portion and a second member element with a second member portion, wherein the first and second member elements are connected to one another in a force-fitting manner by at least two connecting devices such that the member portions overlap one another at least in certain portions in order to damp vibrations that occur and to thus prevent oscillation of the system.

32 Claims, 4 Drawing Sheets

(56) References Cited

U.S. PATENT DOCUMENTS

| | | | | |
|---|---|---|---|---|
| 2018/0043909 | A1* | 2/2018 | Brandstetter | B61F 5/52 |

FOREIGN PATENT DOCUMENTS

| | | | | |
|---|---|---|---|---|
| CN | 2019514820 | U | 8/2011 | |
| EP | 0345709 | | 12/1989 | |
| EP | 0345709 | A1 * | 12/1989 | B61F 5/52 |
| EP | 1415882 | | 5/2004 | |
| EP | 1415882 | A1 * | 5/2004 | B61F 5/52 |
| RU | 2268181 | C2 | 1/2006 | |
| RU | 2283253 | C1 | 9/2006 | |
| RU | 2435690 | C2 | 12/2011 | |

* cited by examiner

CONNECTING MEMBER FOR TWO LONGITUDINAL MEMBERS OF A RAIL VEHICLE

CROSS-REFERENCE TO RELATED APPLICATIONS

This is a U.S. national stage of application No. PCT/EP2016/052821 filed 10 Feb. 2016. Priority is claimed on Austrian application No. A50120/2015 filed Feb. 17, 2015, the content of which is incorporated herein by reference in its entirety.

BACKGROUND OF THE INVENTION

1. Field of the Invention

The invention relates to a connecting member for connecting two longitudinal members of a bogie frame of a rail vehicle, where the connecting member comprises at least one fastening point for receiving add-on components.

2. Description of the Related Art

Bogies of rail vehicles generally comprise a bogie frame having two longitudinal members and a transom member connecting these longitudinal members, wheelsets, which are connected to the longitudinal members via a primary suspension system, and at least one secondary suspension system for attaching a car body. In addition thereto, a series of further add-on components are also necessary to ensure the correct functioning of the bogies or the rail vehicles, such as elements of the train control system (antennas) or lines or their cable and piping components. In order to secure the add-on components to the bogie frame or to connect such components to the longitudinal members, connecting members, also known as head beams, are known that connect the two longitudinal members to one another and have fastening points for receiving the add-on components. Cable clamps or mounting brackets, for example, are connected to the connecting member at such fastening points, such as via bolted joints.

In such arrangements, the connecting members are generally rigidly connected to the longitudinal members. As a result, however, the connecting members act as an additional stiffener of the bogie frame, which leads to a reduced torsional capability of the longitudinal members with respect to one another in the operating state. Rigidly coupled connecting members are therefore likely to be much poorer at adapting to twistings of the track during operation and able to compensate for these to a lesser extent, which results in a worsening of the running characteristics of the bogie.

Also known are connecting members that are mounted so as to be decoupled from the longitudinal members or that consist of torsionally soft profiles. Although the torsional capability of the longitudinal members is restored as a result, at the same time the natural frequency is lowered, thereby potentially leading to an oscillation of the components during operation. It is necessary to avoid the oscillation at all costs. As a result, such connecting members are subject to compromises in terms of structural design, which at any event are associated with corresponding disadvantages.

SUMMARY OF THE INVENTION

In view of the foregoing, it is therefore an object of the invention to overcome the disadvantages of the prior art and to provide a connecting member for connecting two longitudinal members that has the minimum possible impact on the torsional capability of the longitudinal members and at the same time counteracts an oscillation of the system.

This and other objects and advantages are achieved in accordance with the invention by a connecting member for connecting two longitudinal members of a bogie frame of a rail vehicle comprising at least one fastening point for receiving add-on components, where the connecting member comprises at least a first member element with a first member portion and a second member element with a second member portion, and where the member elements are connected to one another in a force-fitting manner by at least two connecting means such that the member portions overlap one another at least in certain portions.

The force-fitting connection of the two member elements can be realized, for example, by connecting means, such as bolts or rivets with corresponding drilled holes in the member elements. With the connecting member connected to the longitudinal members in the operating state, a vibrational excitation of the system will result under load conditions. When the system is subject to the vibrational excitation, micromovements occur between the member elements themselves or between member elements and the connecting means at the connecting points at which the connecting means connect the member elements to one another. These micromovements lead to a damping of the overall vibratory system and thus counteract an oscillation of the overall system. In this case, the overlapping member portions form a major part of the connecting member and consequently serve to bridge the distance between the longitudinal members. As a result of the overlapping, particularly favorable characteristics are produced in this case with respect to the torsional capability.

In an embodiment of the invention, the first member element and the second member element are formed in the shape of a strip in the region of the member portions, such that the member elements extend substantially with a constant cross-section along a longitudinal direction, which longitudinal direction preferably stands normal to the longitudinal members, and bridge the distance between the longitudinal members. In this arrangement, the member elements are formed essentially flat in the region of the member portions.

In order to increase the torsional capability of the connecting member, in a further embodiment of the invention, the first member element and the second member element have an open profile in cross-section. The torsion resistance moment is reduced as a result, such that the connecting member permits greater deformations in the event of a twisting of the longitudinal members. Here, the open profiles are aligned such that they open in the direction facing away from the other member element in each case, i.e., toward the outside.

In preferred embodiments of the connecting member in accordance with the invention the open profile is an L profile or a U profile. Such profiles are easy to produce in terms of manufacturing processes and thus represent a cost-effective alternative to conventional cast or welded parts. Here, the member portions are usually formed by a vertical part of the profile, i.e., either the vertical part of the L profile or the vertically upstanding transverse part of the U profile.

In order, on the one hand, to increase the torsional capability of the connecting member and, on the other hand, to reduce the weight of the connecting member, in a further embodiment of the invention the member elements have a plurality of openings in the overlapping member portions. It has proven particularly advantageous in this case if the member portions form between 70% and 90%, preferably between 80% and 90%, of the length of the member elements, so that a great number of openings can be provided.

In a further embodiment of the invention, the member elements have two fastening portions overlapping in each case, where the connecting means is arranged in the fastening portions. By connecting the two member elements in the fastening portions, it is possible to connect the member elements both to one another and to the longitudinal members, without needing to engage in complicated structural engineering measures. Preferably, the member elements are connected to one another via at least two connecting means per fastening portion in each case in order to minimize the relative movement of the member elements with respect to one another and to increase the stiffness of the connecting member. Thus, for example, the connecting member can be connected to fastening plates rigidly connected, such as welded, to the longitudinal members.

To allow simple attachment of the connecting member to the longitudinal members, in a further preferred embodiment of the connecting member in accordance with the invention the fastening portions are arranged at the ends of the member portions facing in the direction of the longitudinal members in the mounted state. Arranging the fastening portions in those areas of the connecting member that are closest to the longitudinal members reduces the distance to be bridged, such as via fastening elements, between the connecting member and longitudinal members to a minimum.

In order to further improve the torsional capability of the longitudinal members with respect to one another, i.e., by reducing the torsional rigidity and at the same time increasing the shear resistance of the connecting member, in a further preferred embodiment of the invention at least one fastening element in each case is provided for connecting the connecting member to a longitudinal member of the bogie frame. Providing fastening elements furthermore permits a flexible attachment to different longitudinal members and consequently a high degree of adaptability of the connecting member to different bogies.

It is particularly favorable in terms of structural design in this case if the fastening elements have a contact portion that is arranged between the fastening portions of the member elements and is connected to the member elements via the connecting means. Because the, preferably flat, contact portion is accommodated between the two member elements, the connecting means provided for connecting the member elements likewise fixing the fastening elements to the member elements, only a small number of separate components are necessary that form the connecting member. The vibration damping produced by the connecting means is likewise enhanced as a result of the reduced number of components and the connecting means. In particular, micromovements between the contact portion, the fastening portions of the member elements and the connecting means are also possible in this case.

The structural design of the fastening elements also has a direct impact on the strength of the connecting member. As a result, in further preferred embodiments of the invention the fastening elements are formed as a mounting bracket or in an L shape. This type of simple and beneficial design of the fastening elements results, on the one hand, in cost-effective fabrication and assembly and, on the other hand, in a high shear resistance being achieved in the longitudinal direction of the member elements.

In order to cater for different application areas and acceleration levels, in a further embodiment of the connecting member in accordance with the invention the fastening elements each have at least one elastomer element, via which elastomer element the fastening elements can be connected to the respective longitudinal member. When such elastomer elements are used, they absorb deformations arising from the twisting and likewise assume a damping function.

In order to be able to connect add-on components to the connecting member in a simple manner, the first member element includes, in a further preferred embodiment, at least one receiving portion that protrudes at an angle, preferably at a right angle, from the first member portion, where the at least one fastening point is arranged on the receiving portion. In this arrangement, the receiving portion may be formed, for example, as a horizontally disposed part of the L or U profile. Because the receiving portion has at least one fastening point for receiving add-on components, the add-on components can be connected to the connecting member quickly and without great effort, such as via cable clamps bolted on at the fastening points.

In a further embodiment, the second member element includes, in addition to or instead of the receiving portion of the first member element, at least one further receiving portion which protrudes at an angle, preferably at a right angle, from the second member portion, where at least one fastening point is arranged on the further receiving portion. The fastening points may in this case also be formed, for example, as mounting-bracket-like projections of the receiving portions, on which the add-on components are accommodated. By virtue of the flexible configuring and arrangement of the fastening points on the receiving portions, the connecting member in accordance with the invention can thus be easily adapted to the particular bogie and the add-on components that are to be accommodated.

In accordance with a particularly preferred embodiment of the invention, the member elements, preferably also the fastening elements, are implemented as sheet metal bent parts. In this regard, metal sheets have particularly favorable mechanical properties that satisfy the high loading requirements and allow attachment of the add-on components with relatively small wall thicknesses, with the result that a weight reduction compared to conventional connecting members is also possible.

By manufacturing the elements using a bending process, welded joints are avoided, which welded joints generally have a negative impact on the mechanical strength properties, which is attributable to the notch stresses in the welded joint root and the changes in the metallic microstructure due to the action of heat during welding. It has proven particularly advantageous in this regard that the sheet metal bent parts are manufactured from stainless steel, because stainless steel requires no further finishing or coating in order to be protected against corrosion. Thus, points such as those points at which the connecting means are arranged, at which a conventional coating or finishing is not possible or is rubbed off or worn away over time, are also protected against wear and tear and corrosion.

It is also an object of the invention to provide a bogie frame of a rail vehicle having two longitudinal members and an inventive connecting member connecting the longitudinal members. The bogie frame is, in this case, a bogie frame of a bogie of a rail vehicle, to which add-on components are attached via the connecting member. In an embodiment of the invention, the connecting member is connected to the longitudinal members by way of the fastening elements in this case. If the fastening elements in this case have elastomer elements, then the elastomer elements are arranged between the fastening elements and the longitudinal members. The fastening elements can then be connected to the longitudinal members in a particularly simple and stable manner if the fastening elements have a projecting portion that extends in the direction of the respective longitudinal members. This projecting portion, which may be formed as part of an L-shaped or mounting-bracket-like profile, enables a particularly flexible attachment of the connecting member to different positions of the longitudinal member, such as directly to the longitudinal ends or in the clear width spanned between the longitudinal members.

In accordance with a further embodiment of the bogie frame, the connecting member includes a right angle with both longitudinal members. The longitudinal members are aligned parallel to one another in a known manner and the connecting member extends in a substantially rectilinear manner. As a result, a right angle between the longitudinal members and the connecting members results in the connecting member extending parallel to a transom member of the bogie frame and thus, in the event of a twisting of the longitudinal ends of the bogie frame with respect to one another, leads to a uniform deformation of the longitudinal members.

If the cross-section of the first member element is open in a longitudinal direction of the bogie frame and the cross-section of the second member element is open in the direction counter to the longitudinal direction of the bogie frame, i.e. if, in other words, the member elements are aligned in or against the direction of travel, then the twisting of the longitudinal ends of the longitudinal members is not impeded.

Since the connecting member does not necessarily have to be arranged in the clear width between the longitudinal members, which is formed by the parallel configuration of the longitudinal members, but, when viewed from the transom member of the bogie frame, may also be disposed behind the longitudinal ends of the longitudinal members to overlap the longitudinal members in the longitudinal direction of the connecting member, in a preferred embodiment of the bogie frame in accordance with the invention the length of the member elements amounts to between 80% and 120%, preferably 90% and 110%, of the clear width between the two longitudinal members.

In a particularly preferred embodiment of the invention the connecting member, when viewed from the transom member of the bogie frame, is arranged behind a wheel axle of the rail vehicle in order to provide at that position the required fastening points for the add-on components that are to be mounted.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

By way of further explanation of the invention, reference is had in the following part of the description to the figures, from which further advantageous embodiments, details and developments of the invention may be derived. The figures are to be understood as exemplary and are intended to present the character of the invention, though on no account to limit or indeed definitively reflect said character, in which.

DETAILED DESCRIPTION OF THE EXEMPLARY EMBODIMENTS

Figure 1:
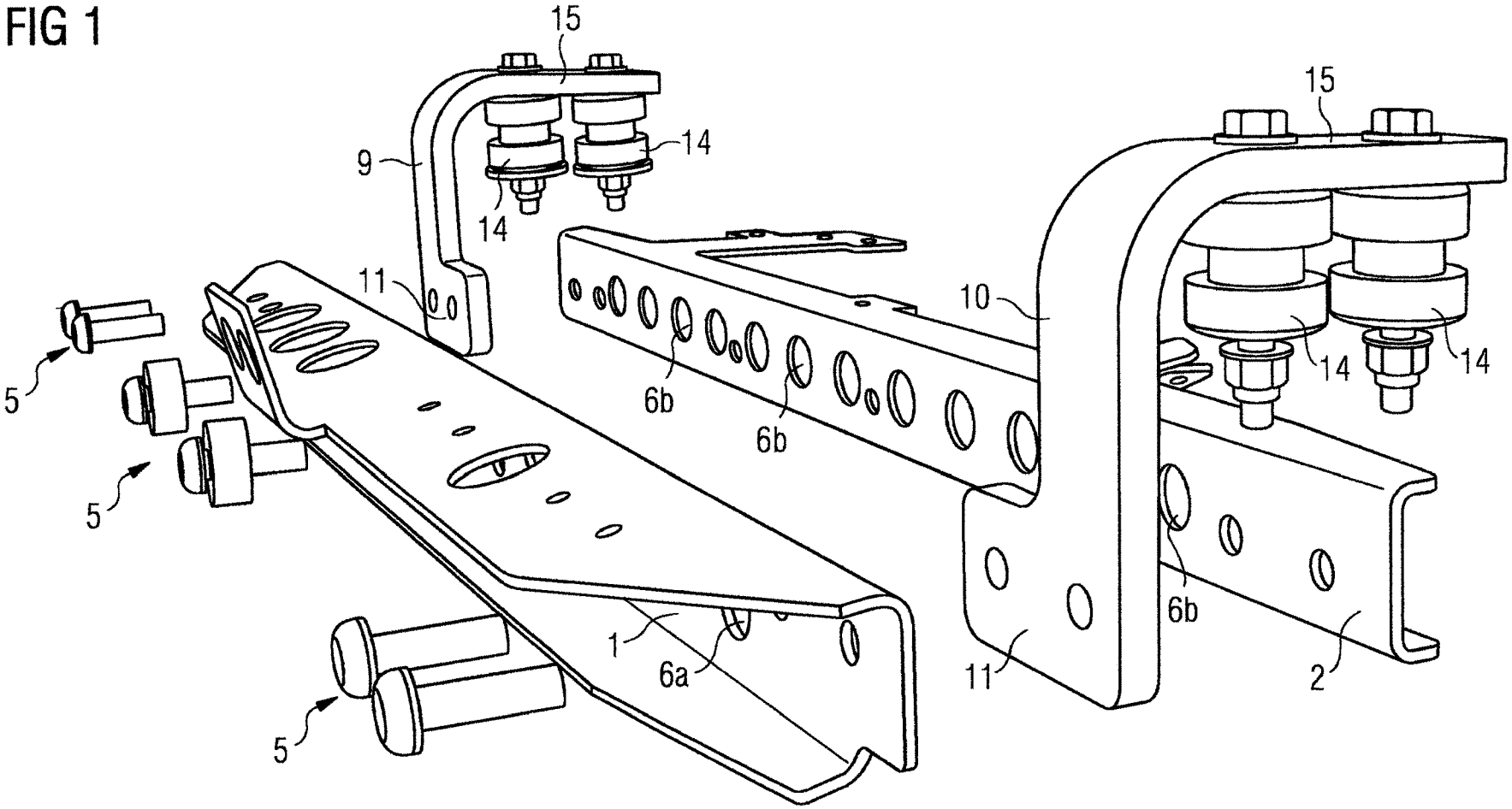
FIG. 1 shows an exploded view of a preferred embodiment of a connecting member in accordance with the invention.
Figure 2:
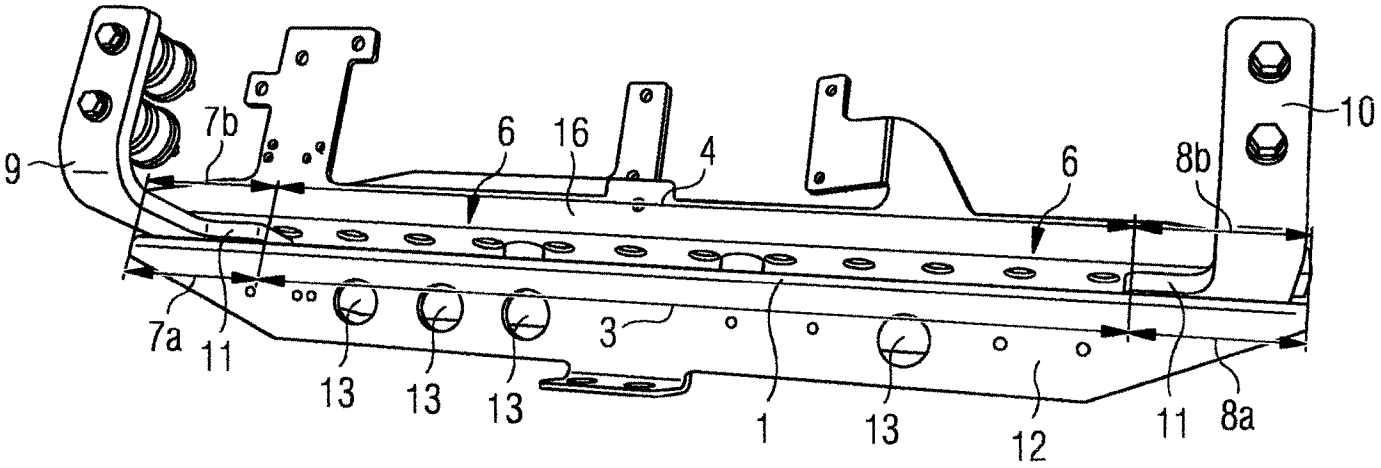
FIG. 2 shows a first axonometric view of the connecting member in accordance with the invention.

FIG. 1 clearly shows the individual components from which the connecting member is constructed, where a first member element 1 and a second member element 2 are formed substantially in the shape of a strip and extend primarily along a longitudinal direction. In this arrangement, the two member elements 1,2 have a U-shaped profile, where the profiles open outward in the opposite direction in each case such that the flat portions of the member elements 1,2 are disposed opposite one another. A first fastening element 9 and second fastening element 10 are arranged in the end-side (when viewed in the longitudinal direction) portions of the member elements 1,2 which, as described in FIG. 2, are formed as a first fastening portion 7 and second fastening portion 8, respectively.

In this configuration, the first fastening element 9 has a flat contact portion 11 that is arranged between the two member elements 1,2 and is connected to the member elements 1,2 with the aid of two connecting means 5, which are formed as threaded bolts, through-hole and threaded nuts. As a result, the member elements 1,2 are spaced at a distance from one another and connected to one another in a force-fitting manner by the connecting means 5 via the first fastening element 9. In addition thereto, the first fastening element 9 is formed as L-shaped, when viewed in the longitudinal direction, such that a projecting portion of the first fastening element 9 faces in the same direction in which the second member element 2 is open. Contact portion 11 and projecting portion 15 include a right angle, here. On the projecting portion 15, the first fastening element 9 has two elastomer elements 14 by which the connecting member can be secured to a longitudinal member of a bogie frame.

The second fastening element 10 is also formed analogously thereto, such that the two member elements 1,2 are connected to one another in a force-fitting manner via the contact portion 11 of the two fastening elements 9,10 with the aid of two connecting means 5, in each case. Arranged in addition thereto in the center of the connecting member are two further connecting means 5 that additionally have a spacer sleeve in order to bridge the distance between the member elements 1,2. These serve as a further way to stiffen the connecting member.

When the two fastening elements 9,10 are connected in the mounted state to the longitudinal members of the bogie frame, micromovements occur in the contact points under conditions of operationally induced vibration excitation in the regions of the member elements 1,2, which are connected to one another in a force-fitting manner via the respective contact portions 11, and at the connecting means 5. These micromovements have a vibration-damping property and thus prevent an oscillation of the overall vibration system, comprising the bogie frame and the connecting member.

The member elements 1,2 have first 6*a* and second 6*b* openings 6 each corresponding to one another to reduce the weight of the connecting member and at the same time to increase the torsional capability, i.e., reduce the torsional stiffness.

FIG. 2 shows the connecting member in an assembled state, the location of the parts with respect to one another not being different from that previously described. In particular, the different portions of the member elements 1,2 are shown in more detail in this view. In its central portion, the first member element 1 has, when viewed normally onto the longitudinal direction, a first member portion 3 in which the first openings 6*a* are arranged. In this case, the first member portion 3 constitutes that flat part of the U profile that is delimited by the two parts protruding at an angle. Equally, the corresponding overlapping portion of the second member element 2 is formed as a second member portion 4 in which the second openings 6*b* are arranged, such that common openings 6 are formed once the member elements 1,2 have been connected.

Arranged at the long-side ends of the member elements 1,2 are the fastening portions 7,8, which are in contact with the contact portions 11 of the fastening elements 9,10 and in which the two connecting means 5 each connect the member elements 1,2 via the fastening elements 9,10. More precisely, the first member element 1 has a first part 7*a* of the first fastening portion 7 at one end and a first part 8*a* of the second fastening portion 8 at the opposite end. The second member element 2 has a second part 7*b* of the first fastening portion 7 overlapping the first part 7*a* of the first fastening portion 7 and an analogous second part 8*b* of the second fastening portion 8. In this arrangement, the member portions 3,4 occupy approximately 75% of the length of the connecting member.

Figure 3:
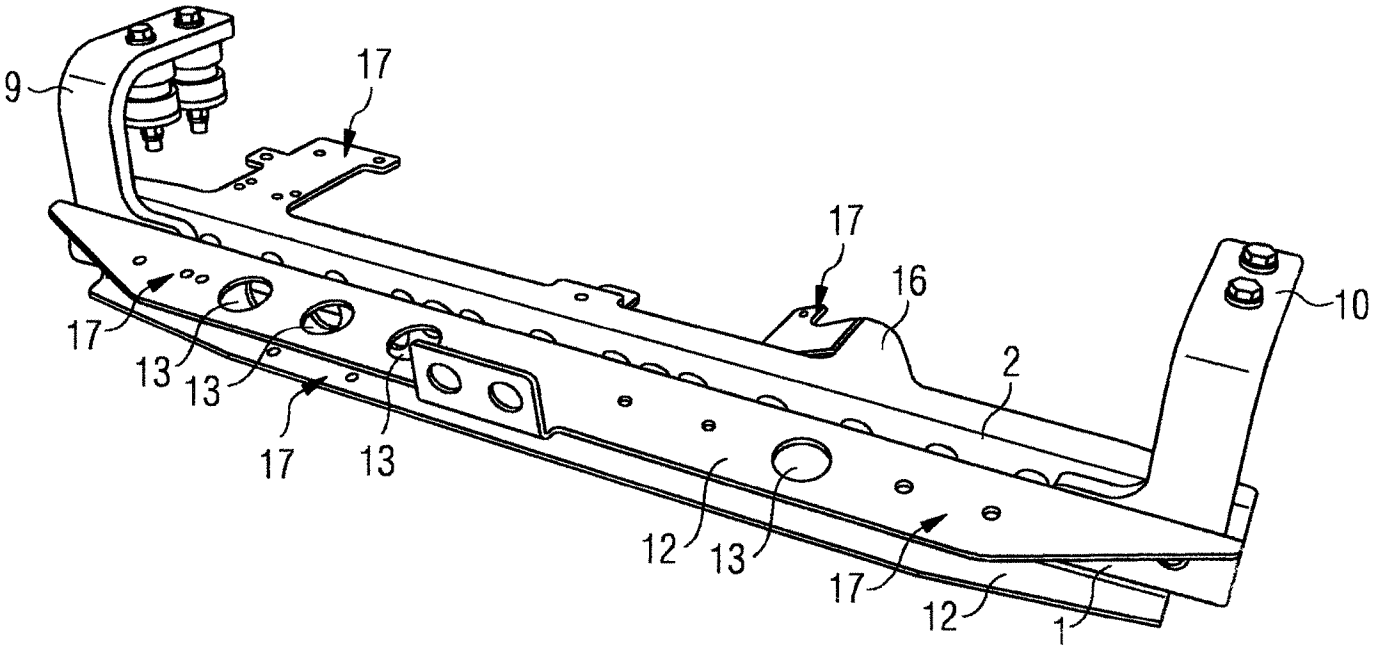
FIG. 3 shows a second axonometric view of the connecting member in accordance with the invention.

FIG. 3 shows, as also already indicated in FIG. 2, two receiving portions 12. These extend away from the second member element 2 at a right angle to the flat part of the first member portion 3 having the openings 6. In the present exemplary embodiment, one receiving portion 12 is thus formed as that part of the open U profile that is formed on the same side into which the fastening elements 9,10 extend, in other words, therefore, on the top side of the connecting member. Fastening points 17 are arranged in the receiving portion 12 for the purpose of receiving add-on components, such as elements of the train control system (antennas), or lines or their cable and piping components, where the fastening points 17 in the present case are implemented as through-holes. Cable clamps or other screwable or bolt-on connecting elements can now be easily secured at the fastening points 17. In order to reduce the weight of the connecting member further, the receiving portion 12 has four further openings 13. A second receiving portion 12 is formed as the other part of the open U profile, in other words, therefore, the underside of the connecting member. This receiving portion 12 also has fastening points 17.

Analogously to the first member element 1, the second member element 2 has two further receiving portions 16, which protrude from the second member portion 4 at right angles on the top side or underside of the second member element 2 or in this case are formed via of the U profile of the second member element 2. The fastening points 17 arranged on the further receiving portion 16 are in this case embodied as projecting portions provided with through-holes.

Thanks to the flexible configuration and arrangement of the fastening points 17 on the receiving portions 12, a connecting member in accordance with the invention can thus be easily adapted to the particular bogie and the add-on components that are to be accommodated.

Figure 4:
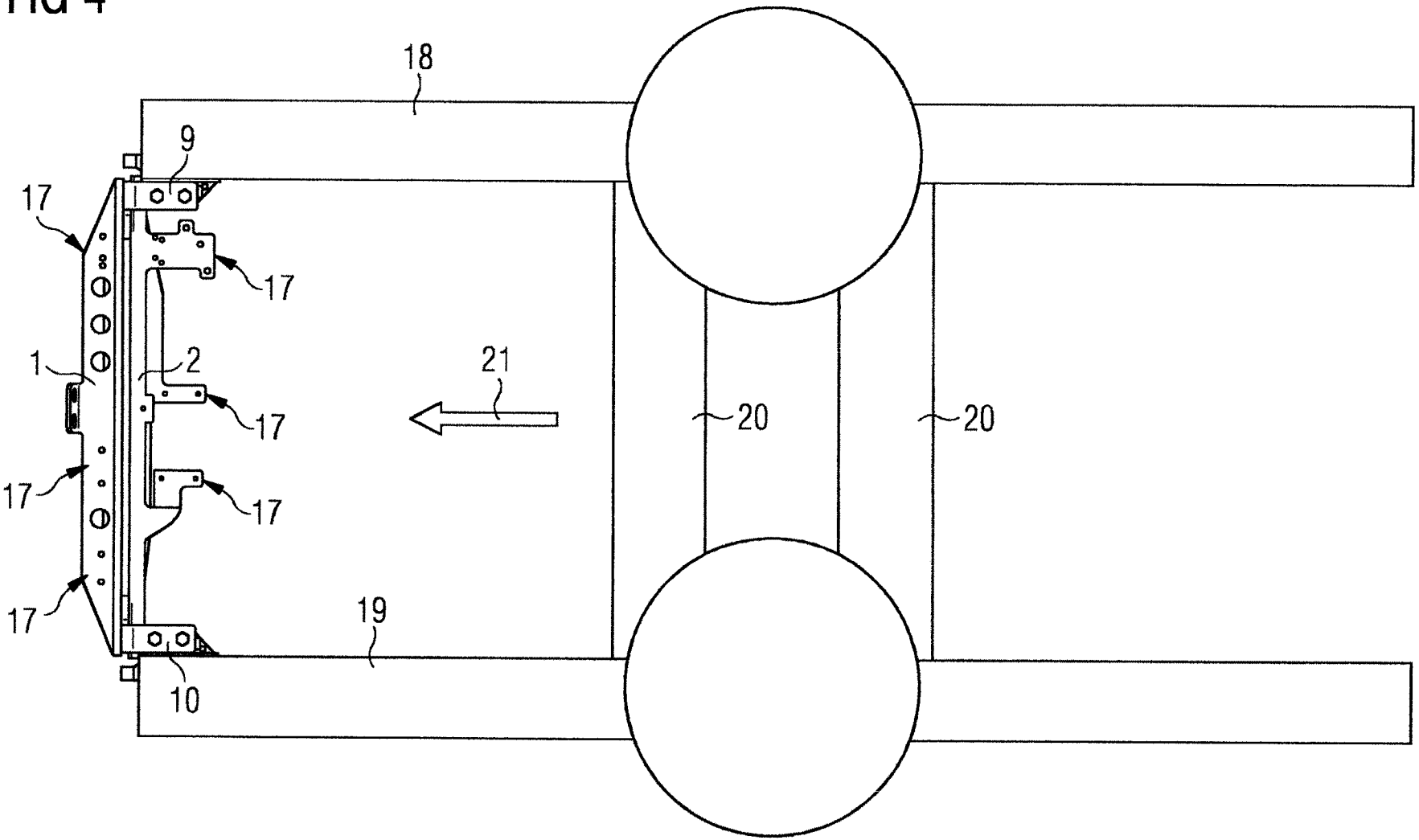
FIG. 4 shows a schematic view of a bogie frame with connecting member in accordance with the invention.
Figure 5:
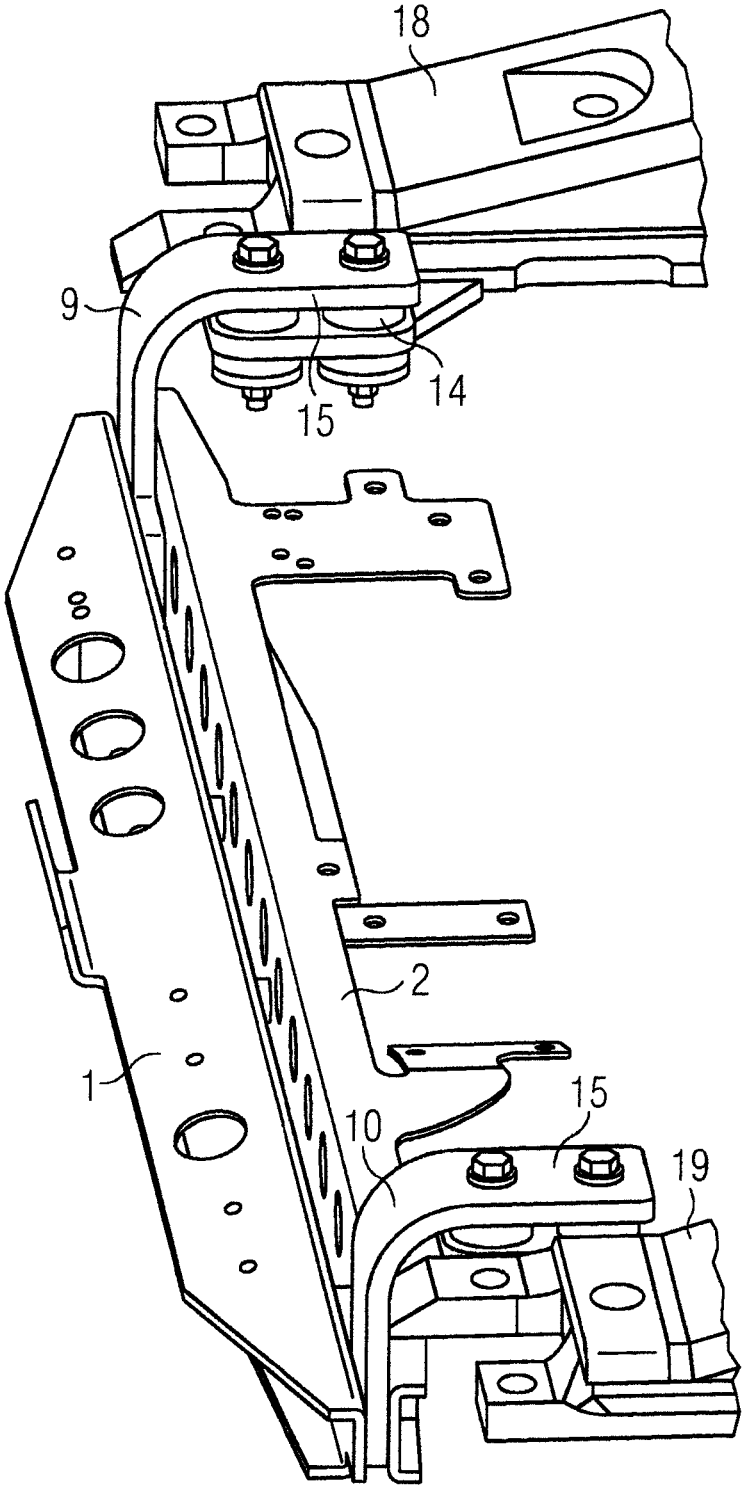
FIG. 5 shows an axonometric view of the connecting member connected to the bogie frame in accordance with the invention.

FIGS. 4 and 5 show a bogie frame with a connecting member. The connecting member or the first and second member elements 1,2 is/are in this case connected via the first fastening element 9 to a first longitudinal member 18 and via the second fastening element 10 to a second longitudinal member 19, where the longitudinal members 18,19 are aligned parallel to a longitudinal direction 21. The longitudinal members 18,19 are furthermore connected via two transom members 20 by which the force flux flows between the longitudinal members 18,19, where the transom members 20 are aligned normally to the longitudinal direction 21. The connecting member is aligned parallel to the transom members 20, i.e., is likewise aligned normally to the longitudinal direction 21. In the interests of clarity, FIG. 4 once again shows those fastening points 17 that are visible in a view from above onto the bogie frame. It is similarly clearly to be seen that the connecting member is arranged at one end of the longitudinal members 18,19 and consequently, when viewed in the longitudinal direction 21 from the transom member 20, is disposed behind a wheel axle (not shown) of the rail vehicle. FIG. 5, in contrast, clearly shows once again the projecting portions 15 of the fastening elements 9,10, which are connected to the longitudinal members 18,19 via elastomer elements 14.

Thus, while there are shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice.

The invention claimed is:

1. A connecting member for connecting two longitudinal members of a bogie frame of a rail vehicle, said connecting member comprising:

at least one fastening point for receiving add-on components; at least a first member element with a first member portion and a second member element with a second member portion; and at least one fastening element is provided for connecting the connecting member to a respective longitudinal member of the bogie frame;

wherein the first and second member elements are connected to one another in a force-fitting manner by at least two connecting means such that the first and second member portions overlap one another at least in certain portions; and wherein the at least one fastening element includes a contact portion which is arranged between the two fastening portions of the member elements and is connected to the first and second member elements via the connecting means.

2. The connecting member as claimed in claim 1, wherein the first member element and the second member element are formed as a strip in a region of the first and second member portions.

3. The connecting member as claimed in claim 1, wherein the first member element and the second member element have an open profile in cross-section.

4. The connecting member as claimed in claim 3, wherein the open profile is an L profile.

5. The connecting member as claimed in claim 3, wherein the open profile is a U profile.

6. The connecting member as claimed in claim 2, wherein the first member element and the second member element have an open profile in cross-section.

7. The connecting member as claimed in claim 1, wherein the first and second member elements have a plurality of openings in the overlapping first and second member portions.

8. The connecting member as claimed in claim 1, wherein the first and second member elements have two fastening portions overlapping in each case; and wherein the at least two connecting means are arranged in the fastening portions.

9. The connecting member as claimed in claim 8, wherein the two fastening portions are arranged at ends of the first and second member portions, said ends facing in a direction of the two longitudinal members in a mounted state.

10. The connecting member as claimed in claim 1, wherein at least one the fastening elements formed as a mounting bracket.

11. The connecting member as claimed in claim 10, wherein the at least one fastening element is formed in an L-shape.

12. The connecting member as claimed in claim 10, wherein the at least one fastening element includes at least one elastomer element via which the at least one fastening element is connectable to the respective longitudinal member.

13. The connecting member as claimed in claim 1, wherein the at least one fastening element is formed in an L-shape.

14. The connecting member as claimed in claim 1, wherein the at least one fastening element includes at least one elastomer element via which the at least one fastening element is connectable to the respective longitudinal member.

15. The connecting member as claimed in claim 1, wherein the first member element includes at least one receiving portion which protrudes at an angle from the first member portion; and wherein at least one fastening point is arranged on the at least one receiving portion.

16. The connecting member as claimed in claim 1, wherein the at least one receiving portion protrudes at a right angle from the first member portion.

17. The connecting member as claimed in claim 1, wherein the second member element includes at least one further receiving portion which protrudes at an angle from the second member portion; and wherein at least one fastening point is arranged on the at least one further receiving portion.

18. The connecting member as claimed in claim 1, wherein the at least one further receiving portion protrudes at a right angle from the second member portion.

19. The connecting member as claimed in claim 1, wherein the first and second member portions form between 70% and 90% of a length of the first and second member elements.

20. The connecting member as claimed in claim 1, wherein the first and second member portions form between 80% and 90% of the length of the first and second member elements.

21. The connecting member as claimed in claim 1, wherein the first and second the member elements are implemented as sheet metal bent parts are implemented as sheet metal bent parts.

22. The connecting member as claimed in claim 1, wherein the first and second the member elements and the at least one fastening element are implemented as sheet metal bent parts.

23. The connecting member as claimed in claim 21, wherein the sheet metal bent parts are fabricated from stainless steel.

24. A bogie frame of a rail vehicle having two longitudinal members and at least one connecting member connecting the two longitudinal members as claimed in claim 1.

25. The bogie frame as claimed in claim 24, wherein the connecting member includes a right angle with the two longitudinal members.

26. The bogie frame as claimed in claim 25, wherein a cross-section of the first member element is open in a longitudinal direction of the bogie frame and a cross-section of the second member element is open in a direction counter to the longitudinal direction of the bogie frame.

27. The bogie frame as claimed in claim 24, wherein a cross-section of the first member element is open in a longitudinal direction of the bogie frame and a cross-section of the second member element is open in a direction counter to the longitudinal direction of the bogie frame.

28. The bogie frame as claimed in claim 24, wherein a length of the first and second member elements amounts to between 80% and 120% of the clear width between the two longitudinal members.

29. The bogie frame as claimed in claim 24, wherein the length of the first and second member elements amounts to between 90% and 110% of the clear width between the two longitudinal members.

30. The bogie frame as claimed in claim 24, wherein the connecting member is connected to the two longitudinal members via the fastening elements.

31. The bogie frame as claimed in claim 24, wherein the fastening elements include a projecting portion which extends in a direction of respective longitudinal members.

32. The bogie frame as claimed in claim 24, wherein the connecting member is arranged behind a wheel axle of the rail vehicle when viewed from a transom member of the bogie frame.

* * * * *